US008474968B2

(12) United States Patent
Yamaguchi

(10) Patent No.: US 8,474,968 B2
(45) Date of Patent: Jul. 2, 2013

(54) INKJET APPARATUS AND HEATING DEVICE

(75) Inventor: Yoshinori Yamaguchi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 115 days.

(21) Appl. No.: 13/209,286

(22) Filed: Aug. 12, 2011

(65) Prior Publication Data

US 2012/0050372 A1 Mar. 1, 2012

(30) Foreign Application Priority Data

Aug. 27, 2010 (JP) ..... 2010-191207

(51) Int. Cl.
*B41J 2/01* (2006.01)

(52) U.S. Cl.
USPC ..... 347/102; 347/17; 347/18

(58) Field of Classification Search
USPC ..... 347/14, 16, 17, 18, 19, 101, 102, 347/104
See application file for complete search history.

(56) References Cited

U.S. PATENT DOCUMENTS 5,428,384 A 6/1995 Richtsmeier
6,059,406 A * 5/2000 Richtsmeier et al. ..... 347/102
7,538,299 B2 * 5/2009 Spence et al. ..... 347/102

* cited by examiner

*Primary Examiner* — Juanita D Jackson
(74) *Attorney, Agent, or Firm* — Canon U.S.A., Inc. IP Division

(57) ABSTRACT

In a stopped state where a sheet is not moving, control is performed so that at a location, the sheet is heated by a heating unit and cooled by a cooling unit at the same time. When the sheet starts moving after the stopped state in order for the inkjet head to apply ink to the sheet, control is performed so that at the location, the sheet continues to be heated by the heating unit and is cooled by the cooling unit at a lower power than in the stopped state.

5 Claims, 6 Drawing Sheets

INKJET APPARATUS AND HEATING DEVICE

BACKGROUND OF THE INVENTION

1. Field of the Invention

Embodiments of the present invention relate to an inkjet apparatus that ejects and applies ink to an object using an inkjet head.

2. Description of the Related Art

An inkjet printer disclosed in U.S. Pat. No. 5,428,384 preliminarily raises the temperature of a sheet by heating the sheet from the reverse side using two heaters, thereby promoting the drying of ink applied to the sheet. The two heaters are a drive roller having a built-in preheating lamp, and a halogen lamp provided under a supporting surface in a print region.

In general, there is a time-lag from when a heater is powered on to when a predetermined amount of heat radiation is reached. If a command to drive the heater is given at the start of printing, the temperature of a part of the sheet passing during the time-lag until temperature rise is lower than desired. In the part, image unevenness such as color unevenness due to incomplete drying of ink may occur. The inkjet printer disclosed in U.S. Pat. No. 5,428,384 is provided with two heating units and preheats a sheet before printing. Providing two heaters increases power consumption and complicates the structure. The larger the printer, the more noticeable this problem.

The inkjet printer disclosed in U.S. Pat. No. 5,428,384 heats a sheet from the reverse side to dry ink droplets on the face. Such a drying method has the following problems. When the sheet used has a large thickness or is made of a highly heat-insulating material (for example, when the sheet is a resin plate or a thick vinyl sheet), it is difficult to efficiently apply heat to ink on the face of the sheet, and high-speed printing is hindered. In the case of a sheet having an adhesion layer on the reverse side thereof, such as a sheet of wall paper, the glue of the adhesion layer may be melted by heating the reverse side of the sheet. The melted glue causes a sheet conveyance jam.

On completion of printing, sheet conveyance is stopped, and the heating by the heater is also stopped. The heater continues to radiate heat due to residual heat even after being stopped. For this reason, the sheet at rest immediately below the heater continues to be heated. If the sheet surface temperature exceeds permissive temperature, the sheet may deform. This phenomenon is particularly noticeable in the case where the sheet is made of a heat-sensitive material such as plastic.

SUMMARY OF THE INVENTION

One disclosed aspect of the embodiments prevents image deterioration due to partial temperature drop of a sheet at the start of printing. One disclosed aspect of the embodiments prevents deformation of a sheet due to partial temperature rise of the sheet after printing.

In an aspect of the embodiments, an inkjet apparatus includes a roller pair that moves a sheet, an inkjet head that applies ink to the sheet being conveyed by the roller pair, a heating unit that heats the sheet at a location downstream of the roller pair in the direction in which the sheet moves, a cooling unit that cools the sheet at the location, and a control unit that, in a stopped state where the sheet is not moving, performs control so that the sheet is heated by the heating unit and cooled by the cooling unit at the same time and that, when the sheet starts moving after the stopped state in order for the inkjet head to apply ink to the sheet, performs control so that the sheet continues to be heated by the heating unit and is cooled by the cooling unit at a lower power than in the stopped state.

In another aspect of the embodiments, an inkjet apparatus includes a roller pair that moves a sheet, an inkjet head that applies ink to the sheet being conveyed by the roller pair, a heating unit that heats the sheet at a location downstream of the roller pair in the direction in which the sheet moves, a cooling unit that cools the sheet at the location, and a control unit that, in a moving state where the sheet is moving while the inkjet head is applying ink to the sheet, performs control so that the sheet is heated by the heating unit and that, when the sheet stops moving after the moving state, performs control so that the sheet is heated by the heating unit at a lower power and cooled by the cooling unit at a higher power than in the moving state.

According to one disclosed aspect of the embodiments, a sheet coming at the start of printing the temperature of which is lower than a predetermined temperature may be immediately heated to the vicinity of the predetermined temperature. That is, image deterioration due to partial temperature drop of a sheet at the start of printing may be prevented. According to one disclosed aspect of the embodiments, by increasing the power of the cooling unit after printing, the temperature rise of a sheet due to residual heat of the heating unit may be prevented, and therefore the deformation of the sheet may be prevented.

Further features of the embodiments will become apparent from the following description of exemplary embodiments with reference to the attached drawings.

DESCRIPTION OF THE EMBODIMENTS

An inkjet printer using a large-sized sheet will be described as an embodiment of the present invention. One disclosed aspect of the embodiments may be applied not only to printers but also to other inkjet apparatuses for various purposes that apply ink to an article using an inkjet method. One disclosed aspect of the embodiments may be widely applied to heating devices that heat a moving article (not limited to a sheet) in order to regulating the temperature thereof.

One disclosed feature of the embodiments may be described as a process which is usually depicted as a flowchart, a flow diagram, a timing diagram, a structure diagram, or a block diagram. Although a flowchart or a timing diagram may describe the operations or events as a sequential process, the operations may be performed, or the events may occur, in parallel or concurrently. In addition, the order of the operations or events may be re-arranged. A process is terminated when its operations are completed. A process may correspond to a method, a program, a procedure, a method of manufacturing or fabrication, a sequence of operations performed by an apparatus, a machine, or a logic circuit, etc.

Figure 1:
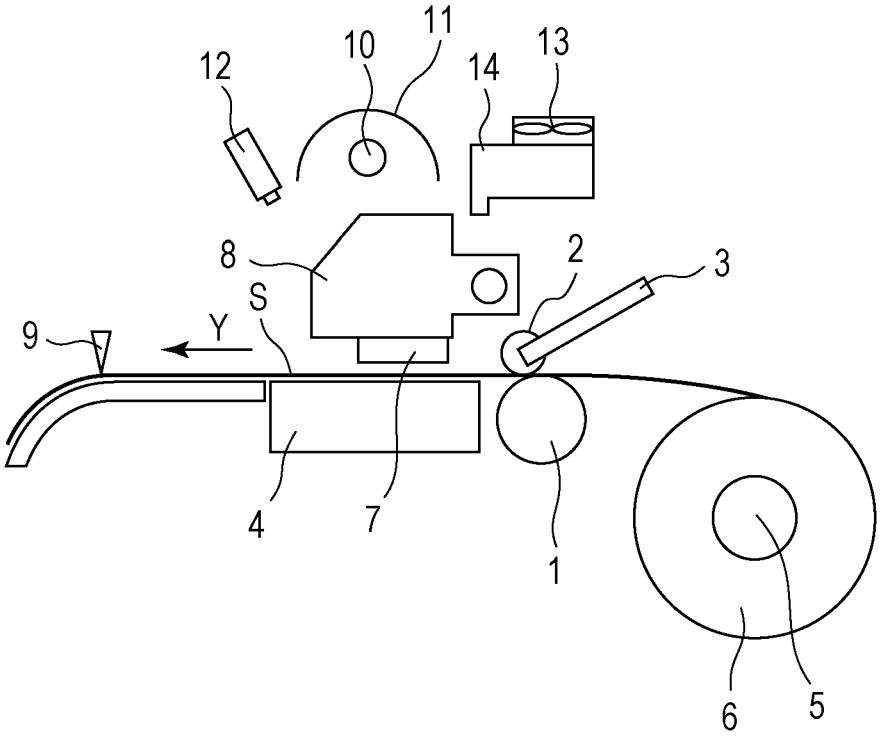
FIG. 1 is a cross-sectional view showing the configuration of an inkjet printer of an embodiment.
Figure 2A:
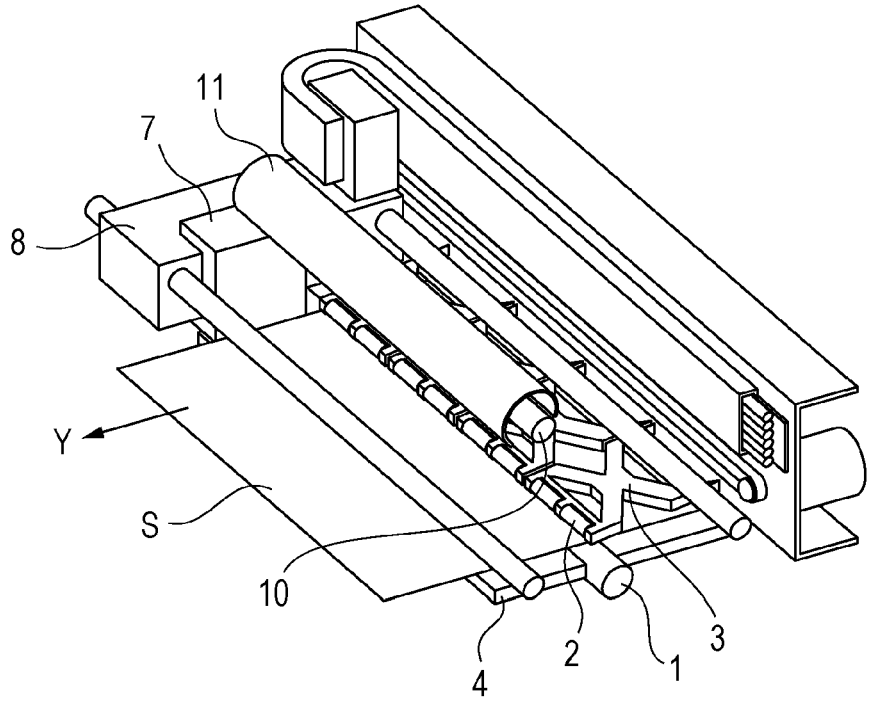
FIGS. 2A and 2B are perspective views of the configuration of FIG. 1 as viewed from an angle.
Figure 2B:
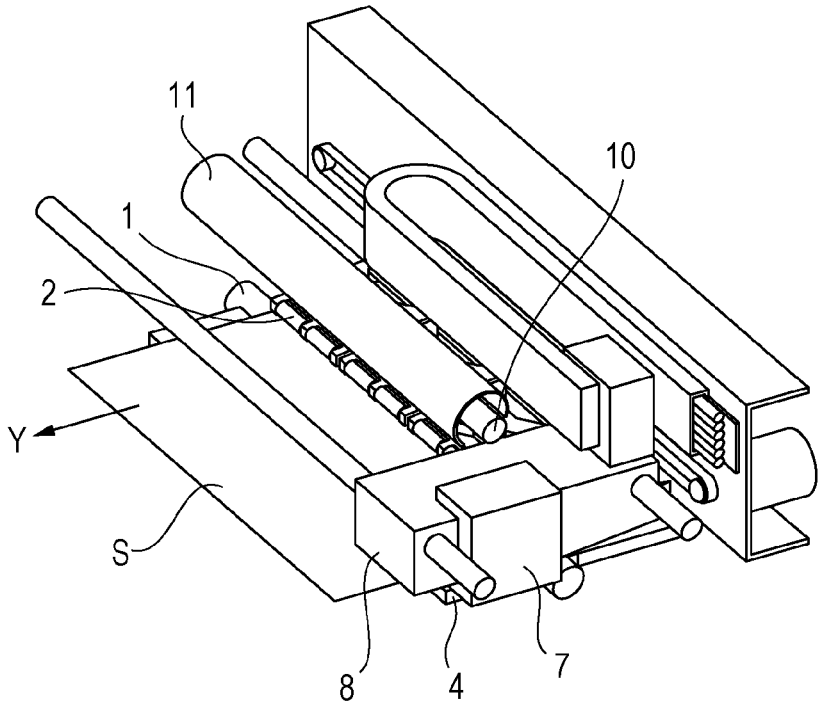

FIG. 1 is a sectional view showing the configuration of an embodiment of the present invention, an inkjet apparatus using a large-sized sheet. FIGS. 2A and 2B are perspective views of the configuration of FIG. 1 as viewed from an angle.

An unused roll sheet 6 is attached to a sheet supply unit 5. The roll sheet 6 is a continuous sheet wound into a web. The roll sheet to be used has a large size, for example, a sheet width of several meters. The sheet S supplied from the sheet supply unit 5 is nipped between a conveying roller pair including a conveying roller 1 to which a rotational drive force is given, and a pinch roller 2 rotating dependently. The conveying roller 1 and the pinch roller 2 have a length corresponding to the maximum sheet width. The conveying roller 1 and the pinch roller 2 may be divided into a plurality of segments. The pinch roller 2 is supported by an arm 3 and is pressed against the conveying roller 1 by elastic force. The arm 3 also has a length corresponding to the pinch roller 2.

The sheet S is conveyed by the rotation of the conveying roller 1 and moves in the sub-scanning direction (leftward in FIG. 1). The moving sheet S passes through a print unit. The print unit has a carriage 8 and a platen 4. The carriage 8 holds an inkjet head 7 and reciprocates in the main scanning direction (the direction perpendicular to the paper plane of FIG. 1). The platen 4 has a sheet supporting surface that supports the sheet S in a print region. FIG. 2A shows a state where the carriage 8 is located at one end. FIG. 2B shows a state where the carriage 8 is located at the other end. A rotary encoder (not shown) detects the rotation of the conveying roller 1. A linear encoder (not shown) detects the position of the reciprocating carriage 8.

The inkjet head 7 may use any one of a method using heaters, a method using piezoelectric elements, a method using electrostatic elements, and a method using MEMS elements. In this embodiment, emulsion ink (dispersal ink) may be used. By heating ink droplets ejected onto the sheet, emulsion ink forms a film and is solidified and fixed to the surface of the sheet. For this purpose, as described later, a heating unit that heats the sheet S is provided.

By alternately repeating the reciprocation of the inkjet head 7 by the carriage 8 (main scanning) and the conveyance of the sheet (sub-scanning), a two-dimensional ink image is formed serially on the sheet S. The printed sheet S is ejected in the Y direction in FIGS. 2A and 2B. Downstream of the print unit, a cutter 9 for cutting the continuous sheet is provided. In this specification, in the direction in which the sheet is conveyed during printing, the side of the sheet supply unit 5 will be referred to as upstream, and the side to which the printed sheet is ejected will be referred to as downstream.

Above the print unit, a heating unit for heating the sheet on the platen 4 and a cooling unit for cooling the sheet on the platen 4 are provided. The positional relationship between the heating unit and the cooling unit is such that they heat and cool the sheet to regulate the sheet temperature at a predetermined position (temperature regulating region) on the downstream side of the conveying roller pair. By appropriately controlling the power of the heating unit and the cooling unit, the surface temperature of the sheet may be regulated. The specific control method will be described later.

The heating unit includes a rod-like heater 10 elongated along the main scanning direction, and a reflector 11 covering a part of the periphery of the heater 10. The heater 10 is a heat source that converts input electric energy into electromagnetic waves (heat rays of infrared rays or far-infrared rays in this embodiment) and radiates them, such as a halogen heater or a sheathed heater. By regulating the amount of input energy, the amount of heat radiation may be changed. The reflector 11 reflects heat rays radiated from the heater 10, thereby deflecting them in substantially one direction. It is ideal that the reflector 11 have a parabolic cross-section at the focus of which the heater 10 is located, and the heater-side surface thereof be smooth like a mirror surface. However, the cross-section of the reflector 11 is not limited to a parabolic cross-section as long as the reflector 11 may deflect heat rays substantially toward the sheet. The reflector is made of a material that resists high temperatures, for example, stainless steel or aluminum. Some of the heat rays radiated from the heater 10 head directly to the platen 4, and the other heat rays are reflected by the reflector 11 and directed mainly to the platen 4. Using the reflector 11, heat rays are concentrated on the sheet on the platen 4. The heating unit applies heat rays (energy for drying ink) to the entire print region substantially uniformly in the main scanning direction. The heat rays radiated from the heating unit are directed to the sheet, and some of them are directed to the upstream side of the platen 4. However, because the pinch roller 2 and the arm 3 are located upstream of the platen 4, many of the heat rays are blocked by them and do not reach the sheet. For this reason, before the sheet reaches the platen 4, the temperature rise of the sheet is small.

The cooling unit includes a blower fan 13 and a duct 14 (not shown in FIGS. 2A and 2B). An airflow is generated by the blower fan 13, and air is blown to the entire main scanning width region on the platen 4 through the duct 14 so as to cool the region substantially uniformly in the main scanning direction. By the airflow, not only the surface of the sheet but also the surrounding component units are cooled. The cooling unit is not limited to a cooling unit that performs cooling by blowing air. The platen 4 may have a built-in cooling unit the cooling power of which is variable (a water-cooling mechanism, an air-cooling mechanism, a Peltier device, or the like) to lower the temperature of the sheet supporting surface of the platen 4.

Thus, the heating unit heats the entire main scanning width region substantially uniformly, and the cooling unit cools the entire main scanning width region substantially uniformly, and therefore the temperature of the sheet is unlikely to be uneven in the main scanning direction.

In the vicinity of the reflector 11, a temperature sensor 12 (not shown in FIGS. 2A and 2B) is provided that detects the information on the temperature of the sheet S in the temperature regulating region in a non-contact manner. As described later, on the basis of the information detected by the temperature sensor 12, at least one of the heating unit and the cooling unit is controlled so that the surface temperature of the sheet S is maintained within a predetermined temperature range during printing.

Figure 3:
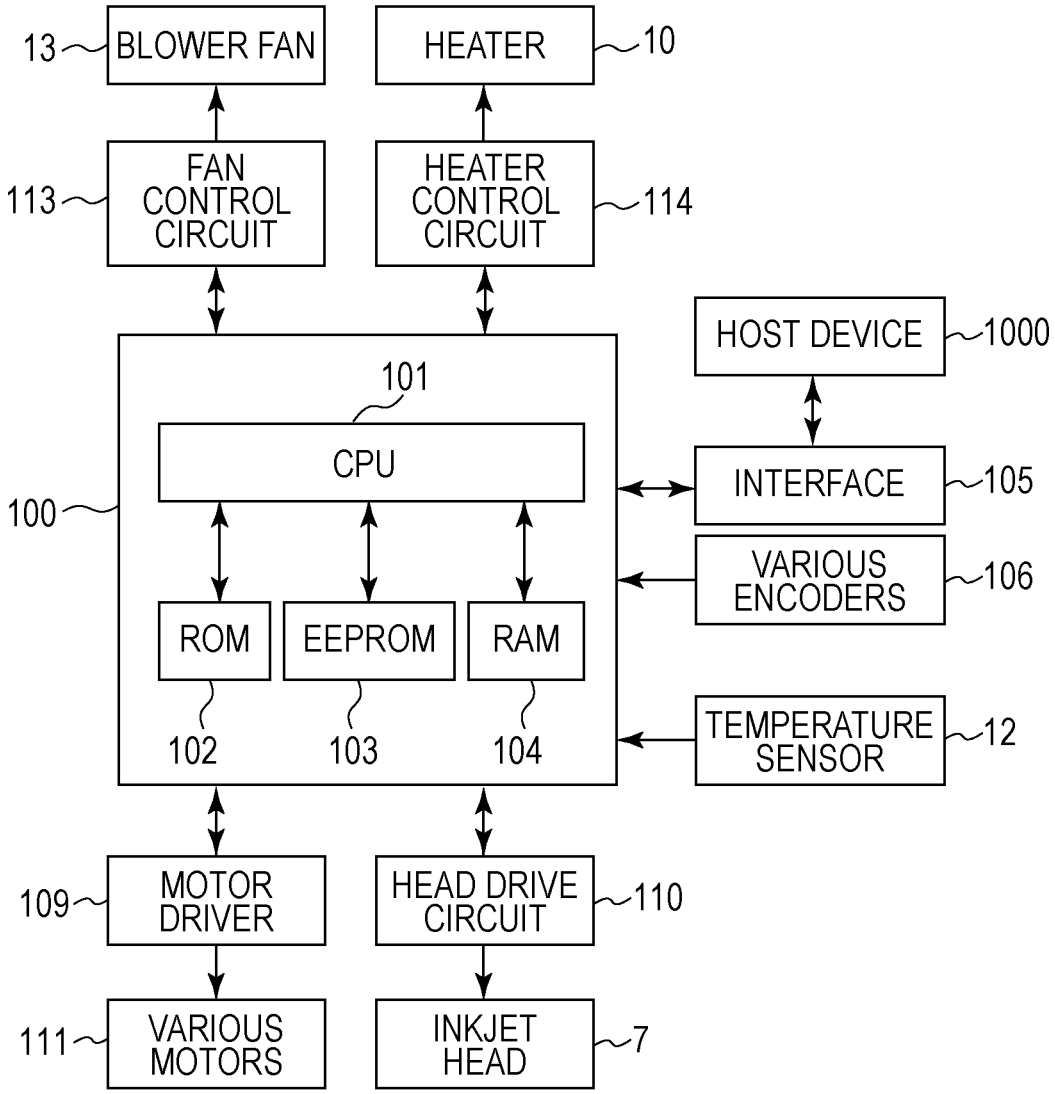
FIG. 3 is a block diagram showing the configuration of a control system.

FIG. 3 is a block diagram showing the configuration of a control system of the inkjet apparatus of the embodiment. A control unit 100 (controller) includes a Central Processing Unit (CPU) 101, a Read-Only Memory (ROM) 102, an Electrically Erasable Programmable Read Only Memory (EEPROM) 103, and a Random Access Memory (RAM) 104 formed on a substrate. The interface 105 is, for example, a Universal Serial Bus (USB) interface. The interface 105 connects the control unit 100 and an external host device 1000, such as a Personal Computer (PC), and allows two-way communication on the basis of a predetermined protocol. Detection results of the encoders 106 and the temperature sensor 12 are input into the control unit 100. The encoders 106 are the above-described rotary encoder that detects the rotation of the conveying roller 1, and the above-described linear encoder that detects the position of the carriage 8. The various sensors 107 are, for example, a sensor that detects the leading edge or trailing edge of the sheet, and a sensor that optically detects the state of the sheet being conveyed. The control unit 100 is connected to a motor driver 109 and a head drive circuit 110. The motor driver 109 drives various motors 111 that are drive sources of the conveying roller 1 and the carriage 8 by commands from the control unit 100. The head drive circuit 110 drives a plurality of nozzles of the inkjet head 7 individually to cause them to eject ink by commands from the control unit 100. The control unit 100 is connected to a fan control circuit 113 and a heater control circuit 114. The fan control circuit 113 controls the rotation state of the blower fan 13 of the cooling unit by commands from the control unit 100. The heater control circuit 114 controls the heat radiating state of the heater 10 of the heating unit by commands from the control unit 100. The control unit 100 controls the power of the heater 10 and the blower fan 13 on the basis of the information detected by the temperature sensor 12 so that the surface temperature of the sheet is maintained within a predetermined temperature range during the printing operation in which ink is applied to the sheet by the inkjet head 7.

The print sequence in the above configuration is based on serial print in which a two-dimensional ink image is formed serially on the sheet S by alternately repeating the reciprocation of the inkjet head 7 by the carriage 8 (main scanning) and the conveyance of the sheet (sub-scanning). In the main scanning in the serial print, a so-called multipath print method is used in which the carriage 8 applies ink to the same part of the sheet a plurality of times while reciprocating, thereby completing an image. In the case where emulsion ink is used, ink applied to a part of the sheet by the inkjet head 7 in a main scanning (path) needs to be dried to form a film before ink is applied to the same part in the next main scanning (path). If film formation of emulsion ink has not been completed before the next main scanning, superimposed inks mix with each other and cause image deterioration due to bleeding or aggregation.

For this reason, the heating unit irradiates the sheet S with heat rays to heat the sheet surface while the carriage 8 is reciprocating in the printing operation. In a region where heat rays are not blocked by the carriage 8 and the inkjet head 7, a surface of the sheet S to which ink is applied is irradiated with heat rays from the heating unit. A part of the sheet is not irradiated with heat rays because heat rays are blocked by the carriage 8 and the inkjet head 7 that are moving. However, because the carriage 8 moves at a substantially constant speed, the accumulated heat ray irradiation to a region of the sheet S to which ink is applied is averaged in the main scanning direction, and therefore the region is heated substantially uniformly in the main scanning direction.

Figure 4:
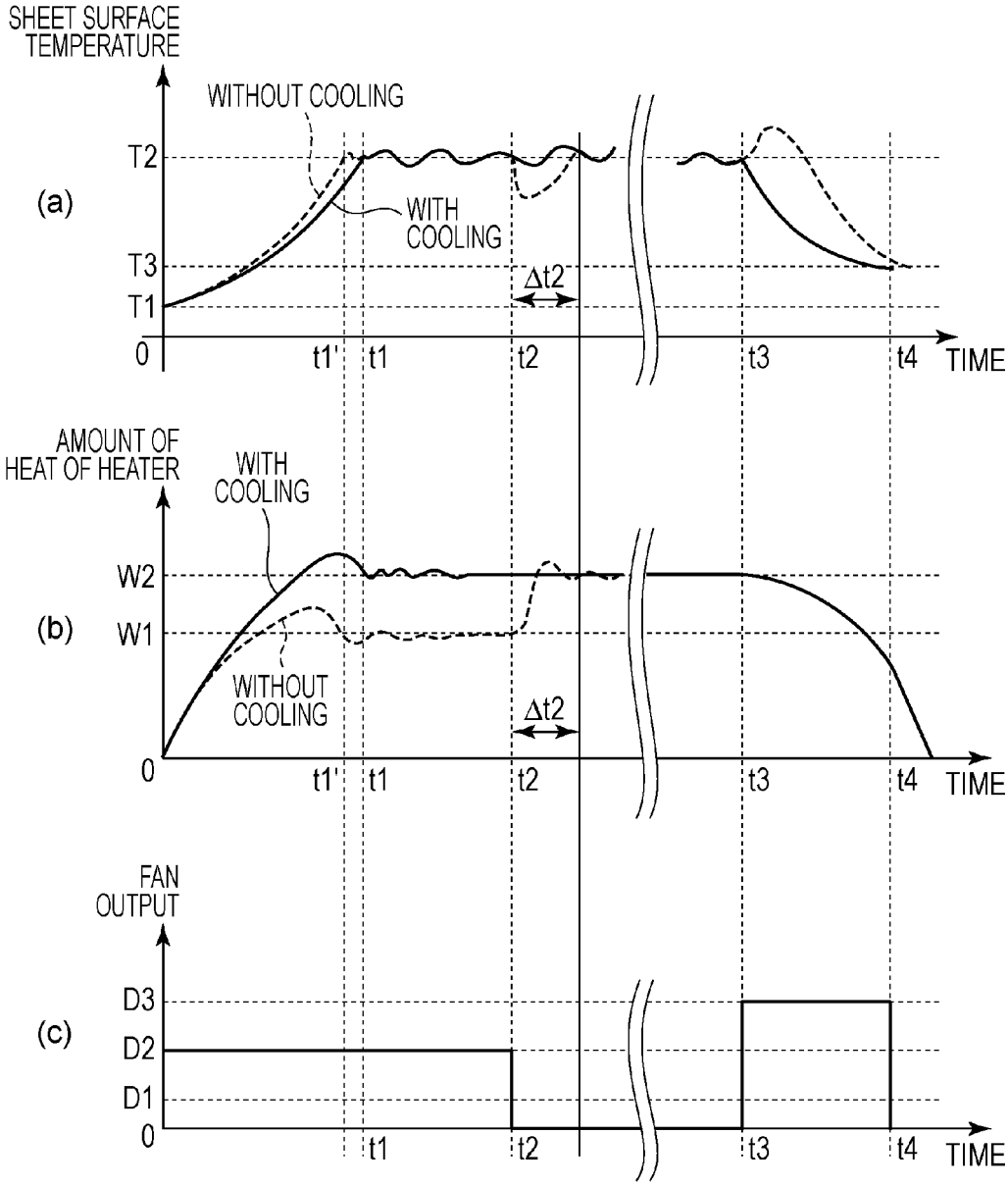
FIG. 4 shows the operation of a heating unit and a cooling unit and the resulting sheet surface temperature changes.

The operation of the heating unit and the cooling unit and the resulting sheet surface temperature changes will be described with reference to FIG. 4. Part (a) of FIG. 4 is a graph showing the changes in surface temperature of the sheet after being heated on the platen 4. That is, part (a) of FIG. 4 shows the surface temperature of the sheet at the position of measurement by the temperature sensor 12. Part (b) of FIG. 4 is a graph showing the changes in the amount of heat radiated by the heater 10 of the heating unit. Part (c) of FIG. 4 is a graph showing the output (the number of revolutions rpm) of the blower fan 13 of the cooling unit. These graphs share a common time axis.

In parts (a) and (b) of FIG. 4, the solid curve (WITH COOLING) shows the change in state in the case of controlling using both the heating unit and the cooling unit. This embodiment is shown by the solid curve. The dashed curve (WITHOUT COOLING) is drawn as a comparative example and shows the change in state in the case where only the heating unit is used and the control of the cooling unit is not performed.

The interval from time 0 to t1 (t1') is a period when the sheet surface is heated by the heating unit until the surface temperature of the sheet at rest rises from an initial sheet surface temperature T1 (for example, 30° C.) to T2 (for example, 60° C.). During this period, sheet conveyance is stopped in a state where the leading edge of the sheet is located on the platen 4. It takes time for the heater to reach a predetermined temperature after the heater is powered on. As shown in part (b) of FIG. 4, the amount of heat radiation increases gradually from time 0 to time t1 (t1'). Time t1 (t1') is, for example, 120 seconds. In this embodiment, at time 0, both of the heater 10 and the blower fan 13 are caused to start operation. As shown in part (c) of FIG. 4, the output of the blower fan 13 is constant (D2), and the amount of cooling is constant. Thus, the sheet surface temperature rises gradually from T1 to T2. In the case of the solid line (WITH COOLING), taking into account the temperature drop due to the cooling performed at the same time as the heating, in order to obtain the sheet surface temperature T2, the amount W2 of heat radiation is larger than the amount W1 of heat radiation in the case of the dashed line (WITHOUT COOLING).

The relationship between W1 and W2 may be expressed as $W1=W2-\Delta Wfs$ ($\Delta Wfs$: the amount of heat removed from the sheet surface by the cooling by the cooling unit). The time (t1) required for the heater 10 to reach the amount W2 of heat radiation is longer than the time required to reach the amount W1 ($<W2$) of heat radiation by $\Delta t$ ($=t1-t1'$). Therefore, the time when the sheet surface reaches the predetermined sheet surface temperature T2 is later than in the comparative example by $\Delta t1$.

The interval from time t1 (t1') to t2 is the period from when the sheet surface temperature reaches the target temperature T2 till when ink is ejected from the inkjet head to start the printing operation. The interval between time t1 and t2 is a mere waiting time and is therefore preferably as short as possible. At least the output of the heater 10 is feedback-controlled so that the sheet surface temperature detected by the temperature sensor 12 is maintained within a predetermined temperature range centered on temperature T2. In the case where cooling is performed at the same time (solid line), the output D2 of the blower fan 13 continues to be maintained as shown in part (c) of FIG. 4. Alternatively, the amount of cooling may be changed by changing the amount of blown air.

At time t2, the printing operation is started. At this time, as shown by the solid line in part (b) of FIG. 4, the amount W2 of heat radiation of the heater 10 is maintained even after time t2. As shown in part (c) of FIG. 4, at time t2, the output of the blower fan 13 is switched to zero (the rotation is stopped). The output does not necessarily have to be switched to zero, and may be reduced to less than D2.

Simultaneously with the start of printing, the conveying roller 1 starts rotating, and new parts of the sheet are conveyed sequentially onto the sheet supporting surface of the platen 4. As described above, many of the heat rays from the heater 10 are blocked by the pinch roller 2 and the arm 3 from reaching the sheet. Therefore, the surface temperature of a coming part of the sheet has not reached T2.

The heater output (the amount W1 of heat radiation) in the comparative example may not heat the moving sheet to the sheet surface temperature T2 in the temperature regulating region. That is, as shown by the dashed line in part (a) of FIG. 4, the temperature drops at time t2. To obtain the sheet surface temperature T2, it is necessary to make the heater output larger than the amount W1 of heat radiation. It takes time $\Delta t2$ to increase the heater output by ΔWp. The temperature of a part of the sheet that has passed through the temperature regulating region during this period is lower than T2. For this reason, the drying of applied ink is not promoted, and the part is prone to image deterioration such as color unevenness. During time Δt2, the sheet moves about 30 cm, and the image in this region may deteriorate.

In contrast, in this embodiment, at a stage before time t2 and in a stopped state where the sheet is not moving, the control unit performs control so that in the temperature regulating region, the sheet is heated by the heating unit (the amount of heat radiation: W2) and cooled by the cooling unit (the amount of cooling: ΔWfs) at the same time. At time t2, the control unit 100 performs control so that in the temperature regulating region, the sheet continues to be heated by the heating unit (the amount of heat radiation: W2) and cooled by the cooling unit at a lower power than in the stopped state. The amount ΔWfs of cooling is equal to the amount ΔWp of heat required to raise the temperature of the low-temperature part of the sheet coming from the upstream side. The term "equal" means not only strictly equal but substantially equal, and is interpreted to have such a meaning throughout this specification.

Thus, the temperature drop of the sheet passing through the temperature regulating region immediately after the start of printing (during Δt2) is small, and good printing may be performed from the leading edge of the sheet. Metaphorically speaking, by depressing both the gas pedal and the brake before printing and releasing only the brake as soon as the printing is started, a quick start is achieved without time-lag. Because a quicker response may be obtained by releasing the brake than by further depressing the gas pedal, the effective amount of heating is increased instantly as soon as the printing is started.

Figure 5:
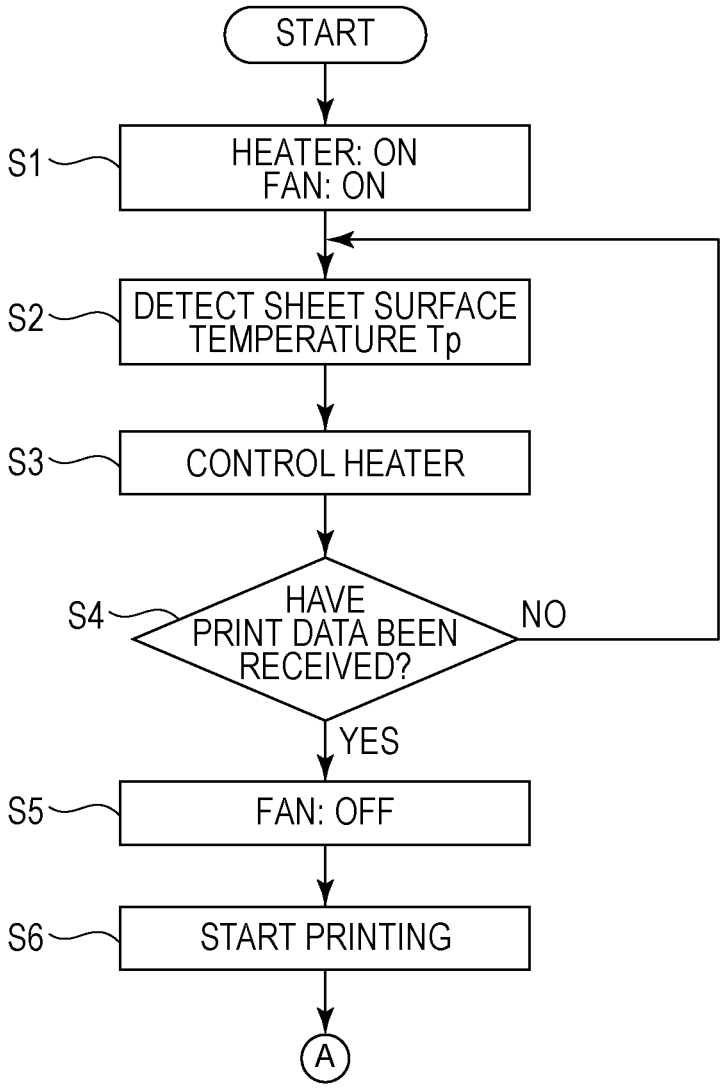
FIG. 5 is a flowchart showing the processing of temperature control before the start of printing.

FIG. 5 is a flowchart showing the processing sequence of temperature control before the start of printing described above. This sequence is performed under the control of the control unit 100 in FIG. 3. In an initial state, the sheet is at rest in a state where the leading edge of the sheet supplied from the sheet supply unit 5 is located on the platen 4. In operation S1, the heater 10 of the heating unit and the blower fan 13 of the cooling unit are both turned on to start heating and cooling. With the increase in the amount of heat radiation of the heater 10, the sheet surface temperature rises gradually. In operation S2, the sheet surface temperature (Tp) in the temperature regulating region is detected using the temperature sensor 12. In operation S3, on the basis of the detected temperature, the output of the heater 10 is feedback-controlled so that Tp approaches T2. By this feedback-control, the sheet surface temperature is maintained within a predetermined narrow temperature range centered on temperature T2. In operation S4, until print data are received, the flow returns to operation S2 and processing is repeated. The time when the determination is "Yes" is time t2 in FIG. 4. In operation S5, the blower fan 13 is stopped. In operation S6, printing is started. The processing of operation S5 and the processing of operation S6 may be performed at the same time, or there may be a slight time-lag between them.

As described above, in a stopped state where the sheet is not moving, the control unit performs control so that the sheet is heated by the heating unit and cooled by the cooling unit at the same time. After the stopped state and when the sheet starts moving in order for the inkjet head to apply ink to the sheet, the control unit performs control so that the heating by the heating unit is continued and the cooling by the cooling unit is at a lower power than in the stopped state.

During the printing after the start of printing, the sheet surface temperature is maintained within a predetermined narrow temperature range centered on temperature T2 by feedback-controlling the heating unit on the basis of the detection of the temperature sensor 12. For any reason, during printing, the sheet surface temperature may rise beyond the predetermined temperature range despite the control of the heating unit. If the sheet surface temperature significantly exceeds T2 during printing, the blower fan 13 of the cooling unit may be activated to perform cooling.

Returning to FIG. 4, time t3 is the time when a predetermined print job on the sheet is completed. On completion of printing, the sheet conveyance is stopped. At the same time, the amount of heat radiation of the heater 10 is reduced. At this time, the amount of heat radiation of the heater 10 decreases not abruptly but gradually as shown in part (b) of FIG. 4. Therefore, the sheet at rest continues to be heated for a while. For this reason, as shown by the dashed line in part (a) of FIG. 4, the sheet surface temperature exceeds T2, and the sheet may be deformed. This phenomenon is particularly noticeable in the case where the sheet is made of a heat-sensitive material such as plastic.

To prevent such a problem, in this embodiment, the blower fan 13 is activated when the printing is completed. In the case where the blower fan 13 operates during the printing, the output of the blower fan 13 is increased when the printing is completed. Let ΔWfe denote the amount of heat removed from the sheet surface by the blower fan 13. The output of the blower fan 13 (fan output D3) is set so that ΔWfs (=ΔWp) <ΔWfe. Thus, as shown by the solid line in part (a) of FIG. 4, the sheet surface temperature lowers gradually without exceeding T2 immediately after time t3. The cooling unit removes surplus heat so that the sheet surface temperature is prevented from significantly exceeding T2 while the conveyance of the sheet is stopped. When the sheet surface temperature is lowered to T3 (for example, 40° C.) (time t4), the blower fan 13 is stopped or the output thereof is reduced. As described above, the sheet surface temperature may be prevented from rising temporarily due to the residual heat of the heating unit immediately after the printing, using the cooling unit. In addition, a part of the airflow produced by the cooling unit removes heat from the area surrounding the stopped heating unit, and therefore the heating unit is cooled more quickly.

In this embodiment, the sheet S is heated by the heating unit with heat rays not from the reverse side but from the face to which ink is applied. For this reason, even if the sheet used has a large thickness or is made of a highly heat-insulating material, ink is efficiently dried, and high-speed printing is achieved. In the case where a sheet having an adhesion layer on the reverse side thereof, such as a sheet of wall paper, is used, the reverse side of the sheet is not heated, and therefore the glue of the adhesion layer is prevented from melting, and a sheet conveyance jam is prevented from being caused by the melted glue.

Figure 6:
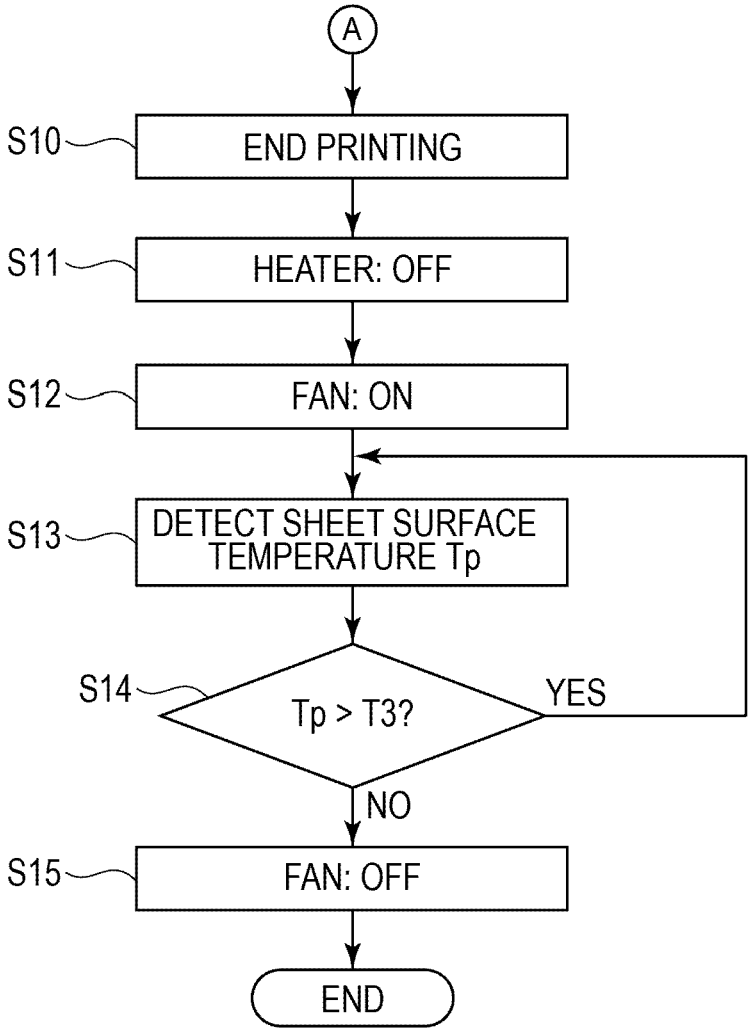
FIG. 6 is a flowchart showing the processing of temperature control after the start of printing.

FIG. 6 is a flowchart showing the processing sequence of temperature control after the start of printing. This sequence is performed under the control of the control unit 100 in FIG. 3. In operation S10, the printing operation is ended. In operation S11, the heater 10 is turned off to stop the operation of the heating unit. In operation S12, the blower fan 13 is turned on to restart the operation of the cooling unit. With decrease in the amount of heat radiation of the heater 10 and cooling, the sheet surface temperature lowers gradually. In operation S13, the sheet surface temperature (Tp) in the temperature regulating region is detected using the temperature sensor 12. In operation S14, it is determined whether Tp>T3 (Yes) or not (No). If the determination is "Yes," the flow returns to operation S13 and processing is repeated. In operation S15, the blower fan 13 is turned off to stop cooling. Thus, all the processing sequences are ended.

As described above, in a moving state where the sheet is moving while the inkjet head is applying ink to the sheet during printing, the control unit performs control so that the sheet is heated by the heating unit. After the moving state and when the sheet stops moving, the control unit performs control so that the sheet is heated by the heating unit at a lower power and cooled by the cooling unit at a higher power than in the moving state.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-191207 filed Aug. 27, 2010, which is hereby incorporated by reference herein in its entirety.

What is claimed is:

1. An inkjet apparatus comprising:

a roller pair that moves a sheet in a direction;

an inkjet head that applies ink to the sheet being conveyed by the roller pair;

a heating unit that heats the sheet at a location downstream of the roller pair in the direction;

a cooling unit that cools the sheet at the location; and a control unit that, in a stopped state where the sheet is not moving, performs control so that the sheet is heated by the heating unit and cooled by the cooling unit at the same time and that, when the sheet starts moving after the stopped state in order for the inkjet head to apply ink to the sheet, performs control so that the sheet continues to be heated by the heating unit and is cooled by the cooling unit at a lower power than in the stopped state.

2. The inkjet apparatus according to claim 1, further comprising a platen that supports the sheet to which ink is applied by the inkjet head, wherein the heating unit irradiates electromagnetic waves toward a surface of the sheet on the platen from a side on which the inkjet head is located, and wherein the roller pair includes a pinch roller that is located on the side and that is supported by an arm, and some of electromagnetic waves irradiated from the heating unit are blocked by the pinch roller and the arm from reaching the sheet.

3. The inkjet apparatus according to claim 1, further comprising a sensor that detects information on the temperature of the sheet at the location, wherein the control unit controls at least one of the heating unit and the cooling unit on basis of the information detected by the sensor so that a surface temperature of the sheet is maintained within a predetermined range while ink is being applied to the sheet by the inkjet head.

4. The inkjet apparatus according to claim 1, wherein the control unit stops moving the sheet in a state where a leading edge of the sheet is located at the location, and performs heating of the sheet with the heating unit and cooling of the sheet with the cooling unit at the same time at the location, and wherein when the surface of the sheet reaches a predetermined temperature range, the control unit starts moving the sheet in order for the inkjet head to apply ink to the sheet, and performs control so that the sheet continues to be heated by the heating unit and is cooled by the cooling unit at a lower power than in the stopped state and thereby the surface temperature of the sheet is maintained within the predetermined range.

5. The inkjet apparatus according to claim 1, wherein the inkjet head ejects emulsion ink.

* * * * *